US011739535B2

(12) United States Patent
Amendolea

(10) Patent No.: US 11,739,535 B2
(45) Date of Patent: Aug. 29, 2023

(54) MOUNTING ASSEMBLY FOR UNIVERSAL GRAB BAR AND HANDRAILS AND GRAB BARS USING SAME

(71) Applicant: Rick Amendolea, Canfield, OH (US)

(72) Inventor: Rick Amendolea, Canfield, OH (US)

( * ) Notice: Subject to any disclaimer, the term of this patent is extended or adjusted under 35 U.S.C. 154(b) by 559 days.

(21) Appl. No.: 17/072,471

(22) Filed: Oct. 16, 2020

(65) Prior Publication Data

US 2021/0079660 A1 Mar. 18, 2021

Related U.S. Application Data

(63) Continuation of application No. PCT/US2019/027592, filed on Apr. 16, 2019.

(60) Provisional application No. 62/658,064, filed on Apr. 16, 2018.

(51) Int. Cl.
*A47H 1/14* (2006.01)
*E04F 11/18* (2006.01)

(52) U.S. Cl.
CPC ..... *E04F 11/1804* (2013.01)

(58) Field of Classification Search
CPC ..... E04F 11/1804
See application file for complete search history.

(56) References Cited

U.S. PATENT DOCUMENTS 2,807,834 A 10/1957 Blum
2,886,278 A 5/1959 Opie
3,161,425 A * 12/1964 Aho ..... E04F 11/1804 256/65.03
3,223,371 A 12/1965 Miller
3,306,641 A 2/1967 Blum et al.
3,343,811 A 9/1967 Kusel et al.
3,433,360 A 3/1969 Duchek et al.
4,650,164 A 3/1987 Shepherd
6,270,058 B1 8/2001 Williams et al.
6,508,458 B1 1/2003 Bartlett et al.
6,932,328 B2 8/2005 Shreiner et al.
7,926,772 B2 * 4/2011 Lowe ..... A47K 10/38 248/220.21
7,967,522 B2 * 6/2011 Goad ..... E04F 11/1808 403/205
8,382,051 B2 * 2/2013 Smith ..... A47K 10/10 248/221.11

(Continued)

*Primary Examiner* — Amy J. Sterling
(74) *Attorney, Agent, or Firm* — Blynn L. Shideler; Krisanne Shideler; BLK Law Group

(57) ABSTRACT

A rapidly mounted, modular, universal handrail and grab bar system uses mounting assemblies therefore. Each mounting assembly includes a clamp having through rail member recesses receiving a rail member generally perpendicular to a clamp longitudinal axis. The clamp includes a closed distal end and proximally extending clamp sides moving toward and away from each other effectively opening and closing the opening size to selectively clamp onto the rail member. A saddle has a curved distal end receiving the rail member, and opposed planar faces receiving the clamp sides, wherein the saddle includes a central fastener opening that extends generally along the saddle longitudinal axis and generally perpendicular to the rail member; and a flange coupled the saddle and fitting over the clamp and selectively moving the clamp sides toward each other to tighten the clamp onto the rail member by decreasing size of the opening.

20 Claims, 3 Drawing Sheets

(56) References Cited

U.S. PATENT DOCUMENTS

| | | | | |
|---|---|---|---|---|
| 8,430,369 | B2 * | 4/2013 | Hsu | A47K 10/04 248/221.11 |
| 9,181,709 | B2 | 11/2015 | Amendolea | |
| 9,822,924 | B2 * | 11/2017 | Wu | F16M 13/02 |
| 11,643,820 | B2 * | 5/2023 | Kuo | A47K 3/003 248/251 |
| 2008/0184475 | A1 | 8/2008 | Sladick et al. | |
| 2013/0167454 | A1 | 7/2013 | Amendolea | |
| 2017/0022717 | A1 | 1/2017 | Amendolea | |
| 2019/0006829 | A1 * | 1/2019 | Daniels | H01R 25/006 |
| 2020/0102753 | A1 * | 4/2020 | Holland | F21V 23/0464 |

* cited by examiner

FIG. 1
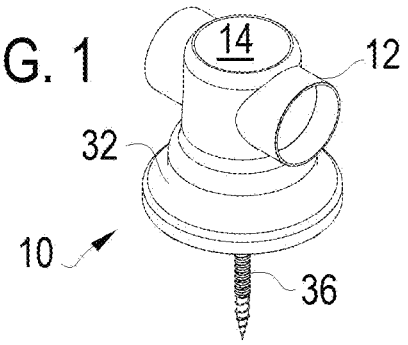
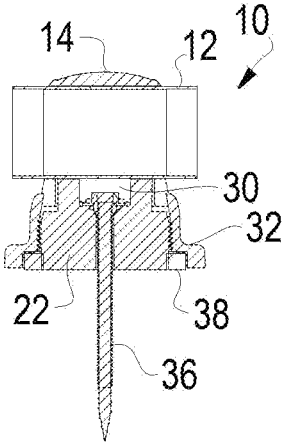
FIG. 3A
FIG. 3B
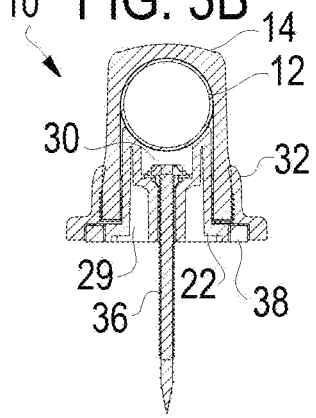
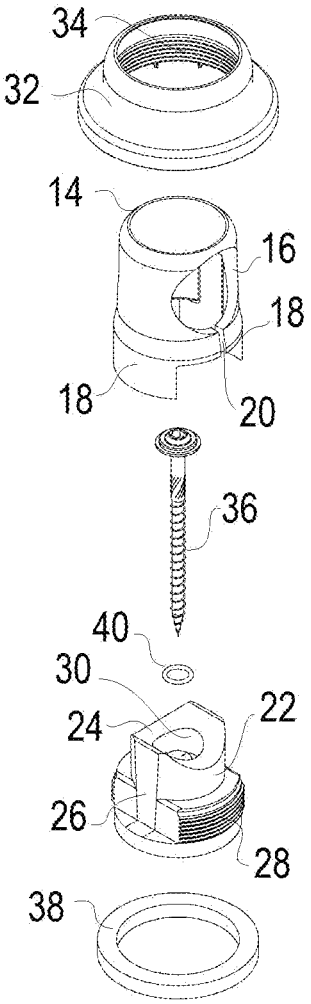
FIG. 2
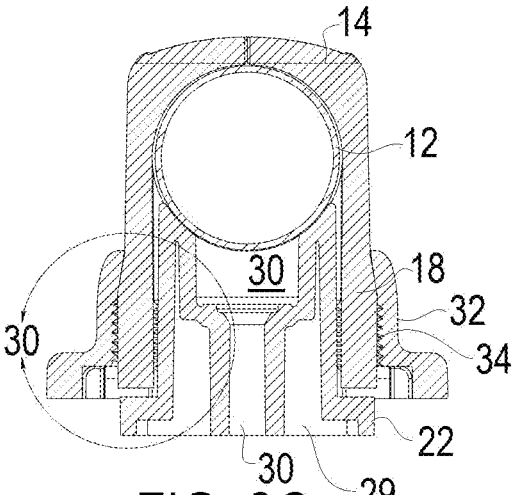
FIG. 3C
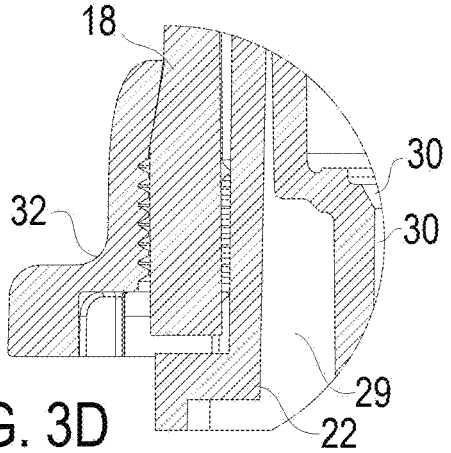
FIG. 3D FIG. 4A
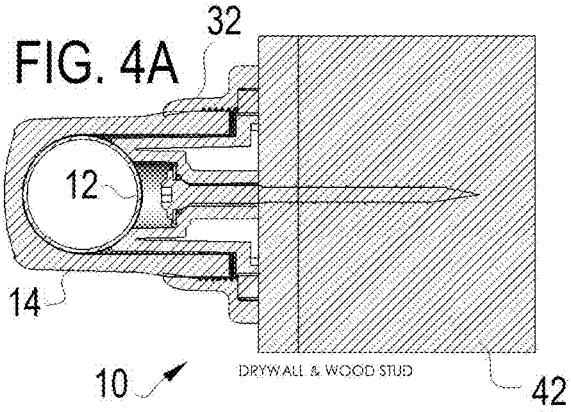
FIG. 4B
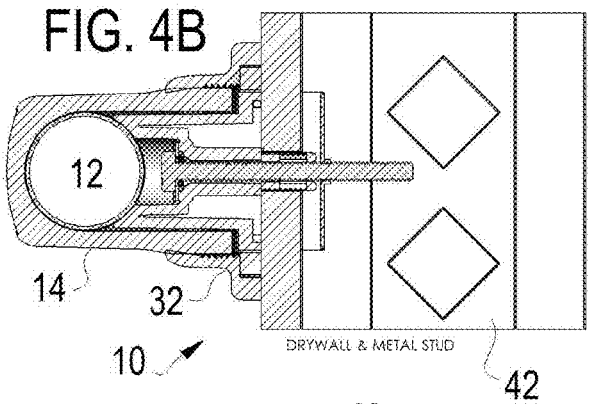
FIG. 4C
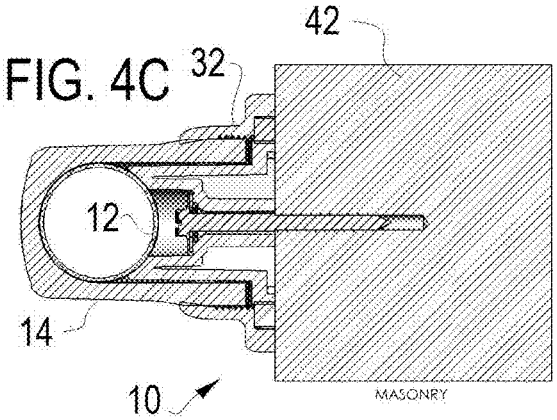
FIG. 4D
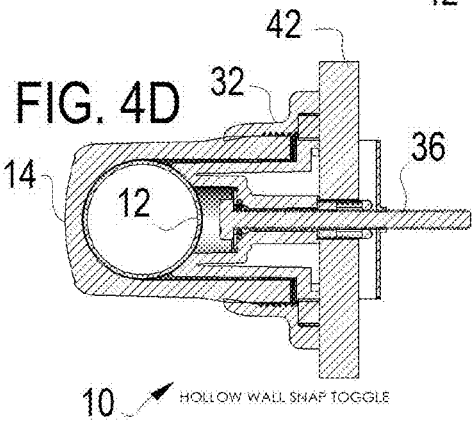
FIG. 4E
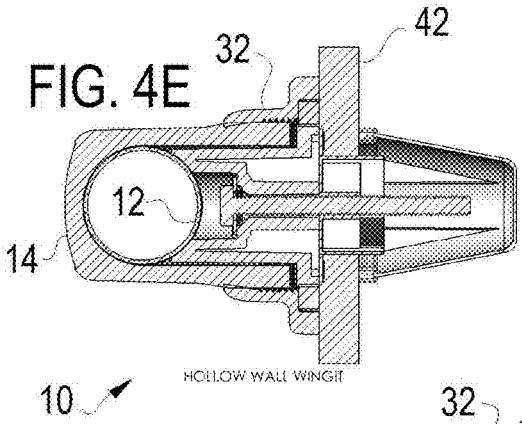
FIG. 4F
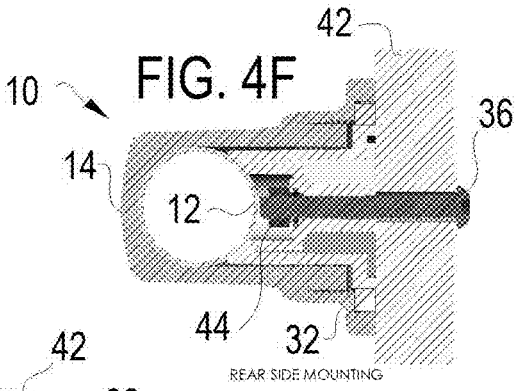
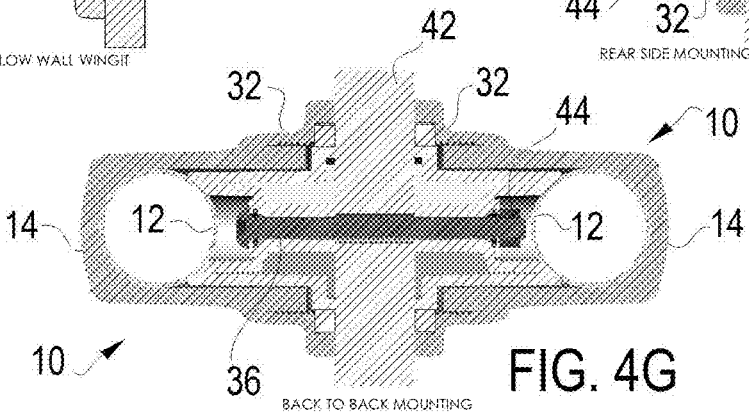
FIG. 4G

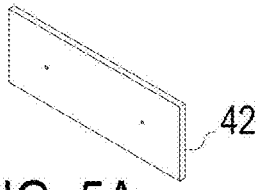
FIG. 5A
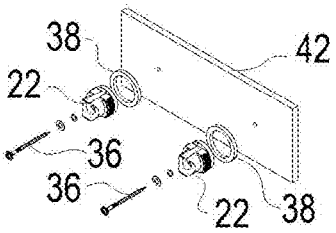
FIG. 5B
FIG. 5C
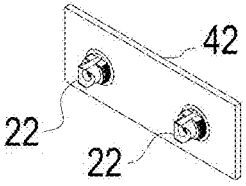
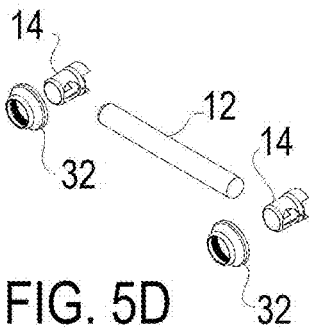
FIG. 5D
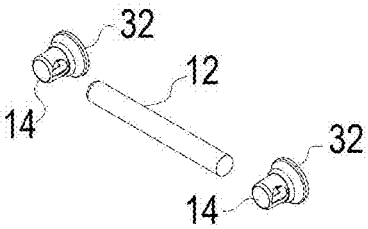
FIG. 5E
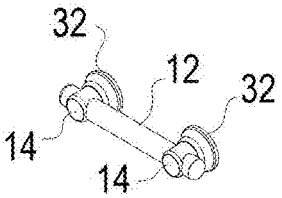
FIG. 5F
FIG. 5G
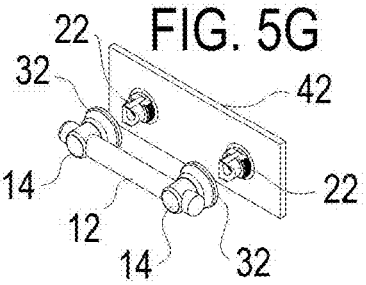
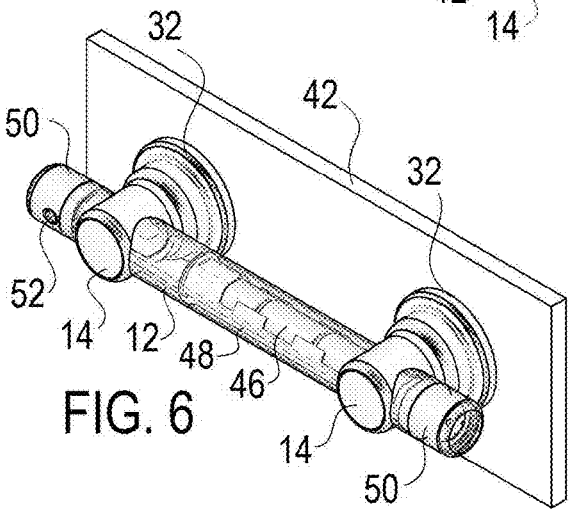
FIG. 6
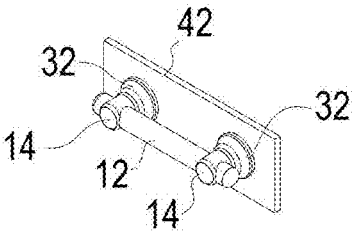
FIG. 5H

MOUNTING ASSEMBLY FOR UNIVERSAL GRAB BAR AND HANDRAILS AND GRAB BARS USING SAME

RELATED APPLICATIONS

This application is a continuation of International Patent Application PCT/US19/027592, filed Apr. 16, 2019 and which published Oct. 24, 2019 as Publication WO 2019/204247, which application and publication are incorporated herein by reference. International Patent Application PCT/US19/027592 claims priority to U.S. patent application Ser. No. 62/658,064 filed Apr. 16, 2018, entitled "Mounting Assembly for Universal Grab Bar and Handrails" which is incorporated herein by reference.

BACKGROUND INFORMATION

1. Field of the Invention

The present invention relates to handrails and grab bars, and more particular to a rapidly mounted mounting assemblies for universal grab bars and handrails.

2. Background Information

A handrail is a rail designed to be grasped by a user's hand so as to provide stability or support and are commonly used while ascending or descending stairways. They can also be called banisters and balustrades. Handrails are typically supported by posts (or balusters) or mounted directly to walls.

Other common handrail applications include handrails surrounding balconies. A further common handrail application is forming a barre (also called a bar), which serve as training aids for ballet dancers.

A further common subset of handrails is known as grab bars. A grab bar is commonly identified as a bar forming a handhold and are commonly found in handicap accessible restrooms where they help people get in and out of wheelchairs and walkers. Grab bars can also be installed in full bathrooms to help people navigate the bathroom. In some homes, grab bars are installed in many locations around the house, anticipating a variety of potential needs. Although there is no precise limit or defining length, a grab bar is generally a shorter type hand rail. In fact in most applications a grab bar is a hand rail having only two supports.

There are a number of hand rail and grab bar systems illustrated in the prior art. U.S. Pat. Nos. 6,932,328, 6,508,458 and 6,270,058 discloses a rail and wall support installation includes an adapter which mechanically couples a wall support having a rotatable locking cam portion to an undercut groove on the rear of the rail.

U.S. Pat. No. 4,650,164 describes handrail system for suspending a handrail spaced from a supporting structure such as a wall. U.S. Pat. Nos. 3,433,360 and 3,343,811 disclose handrail mounting systems of interest and other relevant teachings can be found in U.S. Pat. Nos. 3,306,641, 3,223,371, 2,886,278, and 2,807,834. The international searching authority also listed U.S. Patent Publication 2008-0184475 and Russian reference 160,982 as being documents defining the general state of the art which are not considered to be of particular relevance in International Patent Application PCT/US20/027592.

Many currently available commercial grab bar products are configured with a flange mount that typically utilizes a two or three bolt-mounting pattern. When vertically mounted, these patterns provide for typically only one fastener, at best, on each end to align with a wall stud. If horizontally mounted, engaging a stud with a fastener is only possible if the length of the grab bar is such that it agrees with the spacing of the wall studs, and more often than not, the spacing does not agree. When anchoring to a wall stud is not possible, current grab bar manufacturers recommend using special fasteners such as a Wingits™ brand specialty fasteners and similar fasteners, or toggle bolts or the like. Wingits™ are very expensive and labor intensive. Toggle bolts are not as strong as anchoring to a stud. Consequently wall anchoring of the supports to a stud is preferred.

Thus, for optimum mounting strength, the length of the grab bar must match the spacing of the wall studs so that a fastener can be secured directly to a wall stud. Current commercial grab bar lengths are not adjustable or selectable. As noted above, many if not most of the available grab bar lengths do not agree with stud spacing. Installation is more involved, more time consuming, more labor intensive and more expensive when using special fasteners such as Wingits™ type fasteners, which are necessary when anchoring to a wall stud is not possible.

Despite the plethora of handrail and grab bar systems developed there remains a need for a cost effective rapidly mounted, modular, universal grab bar and handrail system. There is a need for an easy and cost effective rapidly mounted, modular, universal grab bar and handrail system and easy back to back grab bar mounting.

The inventors have addressed some of these deficiencies of the prior art with the rapidly mounted, modular, Universal Grab Bar and Handrail System set forth in U.S. Pat. No. 9,181,709, U.S. Publication 2013/0167454 and U.S. Publication 2017-0022717, which patent and publications are incorporated herein by reference.

The present invention is directed to improvements in the design of the type of the mount for the grab bar and handrails disclosed in the '709 patent and the '454 and '717 patent publications to improve the economic advantage and commercial applicability of the design.

SUMMARY OF THE INVENTION

One embodiment of this invention is directed to a mounting assembly for use in a rapidly mounted, modular, universal handrail and grab bar system. Each mounting assembly includes a clamp having through rail member recesses extending through the clamp configured for receiving a rail member generally perpendicular to a longitudinal axis of the clamp, wherein the clamp includes a closed distal end and proximally extending clamp sides configured to move toward and away from each other effectively opening and closing the size of the opening to selectively clamp onto the rail member received within the rail member recesses, a saddle having a curved distal end configured to receive the rail member, and opposed planar faces configured to receive the clamp sides of the clamp, wherein the saddle includes a central fastener opening that extends generally along the longitudinal axis of the saddle and generally perpendicular to the rail member; and a flange coupled the saddle and configured to fit over the clamp and configured to selectively move the clamp sides toward each other to tighten the clamp onto the rail member by decreasing size of the openings.

It is noted that, as used in this specification and the appended claims, the singular forms "a," "an," and "the" include plural referents unless expressly and unequivocally limited to one referent.

The features that characterize the present invention are pointed out with particularity in the claims which are part of this disclosure. These and other features of the invention, its operating advantages and the specific objects obtained by its use will be more fully understood from the following detailed description and the operating examples.

BRIEF DESCRIPTION OF THE FIGURES

The invention is illustrated by way of example, and not by way of limitation in the figures of the accompanying drawings.

FIG. 1 is a perspective view of a mounting assembly for grab bars and handrails according to one embodiment of the present invention;

FIG. 2 is an exploded perspective view of the mounting assembly of FIG. 1;

FIG. 3A is a sectional view of the mounting assembly of FIG. 1 taken parallel to the length of the grab bar or handrail;

FIG. 3B a sectional view of the mounting assembly of FIG. 1 taken perpendicular to the view of FIG. 3A;

FIG. 3C is an enlarged sectional view of the mounting assembly of FIG. 1 similar to FIG. 3B with the fastener and flange gasket removed for clarity;

FIG. 3D is an enlarged sectional view of a portion of the mounting assembly of FIG. 3C illustrating the cooperation of the flange and clamp sides of the mounting assembly;

FIGS. 4A-G illustrate the various applicable supporting substrates and mounting arrangements for the mounting assembly of FIG. 1;

FIGS. 5A-H illustrate the assembly steps for installing a grab bar with the mounting assemblies of FIG. 1 and FIG. 6 is a perspective view of a lighted grab bar formed using the mounting assemblies of FIG. 1.

DESCRIPTION OF THE PREFERRED EMBODIMENTS

FIG. 1 is a perspective view of a mounting assembly 10 (also called mounts) for grab bars and handrails according to one embodiment of the present invention.

The grab bars and handrails includes at least one stock rail member 12 forming the handhold, wherein each rail member 12 is received within a clamp 14 through rail member recesses 16 which extend through the clamp 14 of each mount 10 such that the rail 12 is configures to extend generally perpendicular to a longitudinal axis of the clamp 14. It is understood that FIG. 1 only shows a small portion of the rail member 12. The stock rail member 12 can be easily formed of common metal bar stock which can be easily cut to length by the user for a designated length. The rail member 12 can have numerous decorative finishes as desired (such as a knurled surface for improved grip) and the material selection is dependent only upon the strength requirements for the grab bar or handrail. Rail member end caps (not shown other than specialized lighted end caps 50 discussed below in connection with FIG. 6) can be used at distal ends of the rail member 12. The end caps can take a variety of decorative shapes and be designed for accessories as discussed below in connection with FIG. 6.

The clamp 14 of each mount 10 includes a closed distal end, proximally extending clamp sides 18 and a pair of openings or slots 20 with each opening 20 extending from a proximal end (closest to the wall or substrate 42) of the clamp 14 to the recess 16. The openings 20 allows the clamp sides 18 to move toward and away from each other effectively opening and closing the size of the recess 16 to clamp onto the rail member 12. As shown and discussed below the openings 20 also allow for a threaded engagement between a saddle 22 and flange 32 of the mount 10. The clamp 14 may be made of any material that allows for the clamping motion and has the structural strength needed for the mount, but molding this from thermoplastics is likely the most cost effective. The clamp 14 can include any ornamental outer configuration and finish as desired. The clamp 14 may further include a set screw in the side thereof for receipt of a set screw there through to engage with the hand rail member 12 to rotationally and axially secure the hand rail member 12 in position, but the clamping aspect of the clamp 14 makes such an additional element unnecessary.

The mount includes a saddle 22 having a curved distal end 24 (farthest from the wall or substrate 42) that is configured to receive the rail 12. The saddle 22 further includes opposed planar faces 26 configured to receive the clamp sides 18 of the clamp 14 and threads 28 for coupling to the flange 32. The saddle 22 includes a central fastener opening 30 that extends generally along the longitudinal axis of the saddle 22 and the mount 10 and generally perpendicular to the axis of the rail member 12. The central fastener opening is stepped to allow for receipt and rotation of the head of a central faster 36 (or a nut 44 in some configurations). The saddle 12 may be formed of any suitable material but it is effectively molded from thermoplastic material and includes a cored out annular portion 29 around the central fastener opening 30 to facilitate the molding process.

In general, each wall support or mount 10 is secured to a substrate 42 such as a wall stud with a single central fastener 36 through the fastener opening 30 in the saddle 22, wherein each central fastener 36 includes a drive head. The central fastener 36 may be any number of conventional fasteners, such as a steel fastener with a hex or Allen head drive head and a wood engaging end for use with the wood studs of the walls. Each mount 10 is, at least at time of initial wall attachment, rotationally adjustable about the central fastener 36 to allow for proper alignment with other laterally spaced wall supports or mounts 10. The mounting assembly 10 provides the advantages of a single point fastening system for a mount which is better elaborated in U.S. Pat. No. 9,181,709, U.S. Publication 2013/0167454 and U.S. Publication 2017-0022717, which patent and publications are incorporated herein by reference.

A key feature of the mount 10 of the present invention is the provision of a flange 32 that is coupled via threads 34 to threads 28 of the saddle 22. The flange fits over the clamp 14 as shown. As best illustrated in FIGS. 3C and 3D, as the flange 32 is threaded on the saddle 22 the conical tapers on the flange 32 and the sides 18 will selectively move or essentially pivot the clamp sides 18 toward each other to tighten the clamp 14 onto the rail member 12 by decreasing the recess 16. The opening 20 allows for the pivoting movement to occur. When the rail member 12 is clamped securely any gaps between the opening 16 and the rail member 12 will disappear, not only securing the rail member 12 but improving the look of the grab bar or handrail system and minimizing dirt buildup in these areas.

The saddle 22 and flange 32, like the clamp 14, may be made of any suitable material exhibiting the structural strength needed for the mount 10, but molding these elements from high strength thermoplastics like the clamp 14 is preferred. The flange 32 and saddle 22 can include any ornamental outer configuration and finish as desired, although no ornamentation is needed on the saddle as it is not visible in the final mount arrangement.

The mount 10 includes a foam flange gasket 38 located adjacent the substrate 42 and secured between the saddle 22 and the flange 32. The gasket 38 provides for a watertight seal of the mount 10 that can be critically important for certain implementations like in a shower or bath. Lock washers 40 may be used around the fastener 36 as well.

FIGS. 4A-G illustrate the various applicable supporting substrates 42 and mounting arrangements for the mounting assembly 10 of FIG. 1. Namely FIG. 4A shows the mount 10 used on a substrate 42 that is drywall/wood stud configuration in which the fastener 36 is configured with a wood engaging proximal end. FIG. 4B shows the mount 10 used on a drywall/metal stud configuration substrate 42 common in commercial settings in which the fastener 36 is configured to engage an anchor within the stud as known in the art. FIG. 4C shows the mount 10 used on a masonry substrate 42 with the fastener suitably chosen for masonry application. In a masonry application the hole receiving the fastener 36 could include a separate element, like a molly, to accommodate the fastener. FIG. 4E shows the mount 10 can be utilized with a hollow wall Wingnut® or other anchor configuration if desired.

The present invention allows for rear mounting configurations shown in 4F in which the fastener 36 actually is driven from the opposite side of the substrate 42 (like a restroom stall divider for example), with a nut 44 within the fastener opening 30 of the saddle 22 to secure the fastener 36. FIG. 4G shows a back to back mounting arrangement of two mounts 10 which might be utilized in on two sides of a stall divider in a restroom.

FIGS. 5A-H illustrate the assembly steps for installing a grab bar with rail 12 using a pair of the mounting assemblies 10 of FIG. 1. FIG. 5A shows a general substrate 42, which may be any of the substrates of FIGS. 4A-f or any known substrate upon which a grab bar is to be mounted, upon which the location of the fasteners 36 is shown and marked. FIGS. 5B and C show the mounting of the saddles 22 with gasket 38 to the substrate 42 through a front mounting of fasteners 36 (which may use lock washers and gaskets around the fastener 36). FIGS. 5D-5F show the sub-assembly of the remaining grab bar components comprising the bar 12, a pair of clamps 14 and pair of flanges 32. The flanges 32 must be placed over the clamp 14 proximal of the openings 16 before the rail 12 is placed through the openings 16 as shown in FIG. 5E and then the rail is placed into the openings 16 as shown in FIG. 5F. The subassembly of FIG. 5F is aligned with the attached saddles 22 as shown in FIG. 5G and threading the flanges 32 onto the saddle 22 will complete the assembly and will clamp the rail 12 into the clamps 14. A spanner, like an oil-filter wrench, may be implemented to tighten the flange 32 onto the saddle 12, but hand tightening is often sufficient.

FIG. 6 is a perspective view of a lighted grab bar formed using the mounting assemblies of FIG. 1 in which the rail 12 houses a battery carrier 48 for batteries 48 that are coupled to lighted end caps 50 (forming a two ended flashlight). The lighted end caps 50 may have a switch 52 for operation and/or motion or light sensors for automatic operation. This specialized use is shown merely for illustrative purposes and other specialized applications are described in detail in U.S. Publication 2017-0022717, which is again incorporated herein by reference.

It will be apparent to those of ordinary skill in the art that various modifications may be made to the present invention without departing from the spirit and scope thereof. The scope of the invention is not to be limited by the illustrative examples described above.

What is claimed is:

1. A mounting assembly (10) for grab bars and handrails comprising:

a clamp (14) having through rail member recesses (16) extending through the clamp (14) configured for receiving a rail member (12) generally perpendicular to a longitudinal axis of the clamp (14), wherein the clamp (14) includes a closed distal end and proximally extending clamp sides (18) configured to move toward and away from each other effectively opening and closing the size of the recess (16) to selectively clamp onto the rail member (12) received within the rail member recess (16);

a saddle (22) having a curved distal end (24) configured to receive the rail member (12), and opposed planar faces (26) configured to receive the clamp sides (18) of the clamp (14), wherein the saddle (22) includes a central fastener opening (30) that extends generally along the longitudinal axis of the saddle (22) and generally perpendicular to the rail member (12); and a flange (32) coupled the saddle (22) and configured to fit over the clamp (14) and configured to selectively move the clamp sides (18) toward each other to tighten the clamp (14) onto the rail member (12) by decreasing size of the recess (16).

2. The mounting assembly (10) for grab bars and handrails according to claim 1, wherein the clamp (14) is molded from thermoplastics.

3. The mounting assembly (10) for grab bars and handrails according to claim 1, wherein the clamp (14) includes a pair of slots (20) with each slot (20) extending from a proximal end of the clamp (14) to the recess (16).

4. The mounting assembly (10) for grab bars and handrails according to claim 1, wherein the saddle includes threads (28) for coupling matching threads (34) on the flange (32).

5. The mounting assembly (10) for grab bars and handrails according to claim 1, wherein the central fastener opening (30) of the saddle (22) is stepped to allow for receipt and rotation of a head of a central faster (36) or an associated nut (44).

6. The mounting assembly (10) for grab bars and handrails according to claim 1, wherein the saddle (22) includes a cored out annular portion (29) around the central fastener opening (30).

7. The mounting assembly (10) for grab bars and handrails according to claim 1, further including a foam flange gasket (38) secured between the saddle (22) and the flange (32).

8. The mounting assembly (10) for grab bars and handrails according to claim 1, wherein the saddle (22) is molded from thermoplastics.

9. The mounting assembly (10) for grab bars and handrails according to claim 1, wherein the flange (32) is molded from thermoplastics.

10. A grab bar assembly comprising:

At least a pair of mounting assemblies (10), wherein each mounting assembly (10) includes i) a clamp (14) having through rail member recesses (16) extending through the clamp (14) configured for receiving a rail member (12) generally perpendicular to a longitudinal axis of the clamp (14), wherein the clamp (14) includes a closed distal end and proximally extending clamp sides (18) configured to move toward and away from each other effectively opening and closing the size of the recess (16) to selectively clamp onto the rail member (12) received within the rail member recess (16), ii) a saddle (22) having a curved distal end (24) configured to receive the rail member (12), and opposed planar faces (26) configured to receive the clamp sides (18) of the clamp (14), wherein the saddle (22) includes a central fastener opening (30) that extends generally along the longitudinal axis of the saddle (22) and generally perpendicular to the rail member (12); and iii) a flange (32) coupled the saddle (22) and configured to fit over the clamp (14) and configured to selectively move the clamp sides (18) toward each other to tighten the clamp (14) onto the rail member (12) by decreasing size of the recess (16);

a rail member (12) configured to be received in each recess (20) of each mounting assembly and on each curved distal end (24) of each saddle (22); and a central fastener received within each central fastener opening (30) of each saddle (22).

11. The grab bar assembly according to claim 10 wherein the grab bar assembly is mounted to a second grab bar assembly through a substrate (42) in a back to back mounting configuration.

12. The grab bar assembly according to claim 11, wherein each clamp (14) includes a pair of slots (20) with each slot (20) extending from a proximal end of the clamp (14) to the recess (16).

13. The grab bar assembly according to claim 12, wherein each saddle includes threads (28) for coupling matching threads (34) on the flange (32).

14. The grab bar assembly according to claim 13, wherein each saddle (22) includes a cored out annular portion (29) around the central fastener opening (30).

15. The grab bar assembly according to claim 14, wherein each saddle (22) is molded from thermoplastics.

16. The grab bar assembly according to claim 10, wherein each clamp (14) includes a pair of slots (20) with each slot (20) extending from a proximal end of the clamp (14) to the recess (16).

17. The grab bar assembly according to claim 16, wherein each saddle includes threads (28) for coupling matching threads (34) on the flange (32).

18. The grab bar assembly according to claim 16, wherein each saddle (22) includes a cored out annular portion (29) around the central fastener opening (30).

19. The grab bar assembly according to claim 10, wherein each saddle (22) includes a cored out annular portion (29) around the central fastener opening (30).

20. The grab bar assembly according to claim 19, wherein each saddle (22) is molded from thermoplastics.

* * * * *